US007096841B2

(12) United States Patent
Hattori et al.

(10) Patent No.: US 7,096,841 B2
(45) Date of Patent: Aug. 29, 2006

(54) START CONTROL APPARATUS OF INTERNAL COMBUSTION ENGINE

(75) Inventors: Fumiaki Hattori, Susono (JP); Masahiro Minami, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/883,737

(22) Filed: Jul. 6, 2004

(65) Prior Publication Data

US 2005/0022779 A1 Feb. 3, 2005

(30) Foreign Application Priority Data

Jul. 31, 2003 (JP) ..... 2003-283391

(51) Int. Cl.
*F01L 13/08* (2006.01)
*F02N 11/08* (2006.01)

(52) U.S. Cl. ..... 123/182.1

(58) Field of Classification Search ..... None
See application file for complete search history.

(56) References Cited

U.S. PATENT DOCUMENTS 6,705,257 B1 * 3/2004 Shimizu ..... 123/90.15

FOREIGN PATENT DOCUMENTS

| | | |
|---|---|---|
| JP | 05-312083 | 11/1993 |
| JP | 10-227236 | 8/1998 |
| JP | 2001-173488 | 6/2001 |
| JP | 2002-004985 | 1/2002 |

* cited by examiner

*Primary Examiner*—Andrew M. Dolinar
(74) *Attorney, Agent, or Firm*—Oliff & Berridge, PLC

(57) ABSTRACT

A start control apparatus of an internal combustion engine comprises an ignition device for igniting an air-fuel mixture in a combustion chamber of the internal combustion engine, a start demanding device for demanding a start of the internal combustion engine, a starting device for starting the internal combustion engine, a determining device for determining a possibility of a self-ignition of the internal combustion engine at a time when a start demand is issued from the start demanding device, and a start procedure control device for igniting the air-fuel mixture in the combustion chamber by the ignition device after the start demand from the start demanding device in the case where the determining device determines that the possibility of the self-ignition of the internal combustion engine is higher than a predetermined level, thereafter starting the internal combustion engine by the starting device.

4 Claims, 8 Drawing Sheets

START CONTROL APPARATUS OF INTERNAL COMBUSTION ENGINE

BACKGROUND OF THE INVENTION

1. Field of the Invention

The present invention relates to a start control apparatus for inhibiting self-ignition at the time of starting an internal combustion engine.

2. Description of the Related Art

There has been known technique of improving exhaust emission by continuously executing an ignition control even after operating so as to stop an internal combustion engine, and stopping the ignition control after completely burning fuel in a cylinder (refer to JP 5-312083 A). In addition, JP 2002-4985 A, JP 2001-173488 A, and JP 10-227236 A exist as prior art documents relevant to the present invention.

In a so-called cylinder direct injection type engine in which fuel is directly injected into each cylinder, since a fuel injection having comparatively high penetration force is executed, the fuel tends to be attached to a wall surface in the cylinder. Further, when the attached fuel is vaporized during an engine stop, there is a possibility that an air-fuel mixture having a high concentration of combustible gas is generated in the cylinder. In particular, in the case where the engine is stopped after a high load operation, the engine is stopped with keeping a high temperature. Accordingly, the attached fuel tends to be vaporized, and there is a high possibility that the air-fuel mixture in the cylinder reaches a combustible concentration. In the case where the engine is restarted in a state in which the air-fuel mixture having the high concentration of the combustible gas exists in the cylinder as mentioned above, there is a possibility that self-ignition is caused in a compression stroke at the time of cranking. Further, in the case where the temperature of the engine is high, the self-ignition tends to be caused. The self-ignition causes a starting property of the engine to be deteriorated.

Further, the self-ignition is also caused by the matter that the fuel attached to an intake port is vaporized so as to flow into the cylinder. Therefore, there is a possibility that the self-ignition is caused in an engine in which the fuel is injected to the intake port as well as the cylinder direct injection type engine.

However, in the prior art, the unburned fuel is burned only at a time while the engine is being stopped. Accordingly, even in the case of controlling the concentration of the unburned fuel in the cylinder to be less than the combustible concentration at the time of stopping the engine, the concentration of the unburned fuel reaches the combustible concentration at the time of restarting due to the vaporization of the attached fuel during the engine stop, and there is a possibility that the self-ignition is caused.

SUMMARY OF THE INVENTION

Accordingly, an object of the present invention is to provide a start control apparatus of an internal combustion engine capable of inhibiting self-ignition caused at the time of starting the internal combustion engine.

In order to achieve the object mentioned above, according to the first aspect of the present invention, there is provided a start control apparatus comprising: an ignition device for igniting an air-fuel mixture in a combustion chamber of the internal combustion engine; a start demanding device for demanding a start of the internal combustion engine; a starting device for starting the internal combustion engine; a determining device for determining a possibility of self-ignition of the internal combustion engine at a time when a start demand is issued from the start demanding device; and a start procedure control device for igniting the air-fuel mixture in the combustion chamber by the ignition device after the start demand is issued from the start demanding device in the case where the determining device determines that the possibility of the self-ignition of the internal combustion engine is higher than a predetermined level, thereafter starting the internal combustion engine by the starting device.

According to the start control apparatus of the first aspect of the present invention, in the case where it is determined by the determining device that the possibility of the self-ignition is high, the air-fuel mixture in the combustion chamber is ignited before starting the internal combustion engine and the air-fuel mixture is burned. Therefore, it is possible to inhibit the self-ignition. Further, since the air-fuel mixture is discharged after being burned, it is possible to prevent an exhaust emission from being deteriorated.

The start control apparatus according to the first aspect of the present invention may comprise a compression cylinder determining device for determining a cylinder which is first in a compression stroke at the time of starting the internal combustion engine, wherein the start procedure control device may apply the ignition of the air-fuel mixture in the combustion chamber by the ignition device only to the cylinder, which is first in the compression stroke at the start time, determined by the compression cylinder determining device. In the case where the ignition is applied only to the cylinder which is first in the compression stroke at the time of starting as mentioned above, it is possible to save an electric power consumption at the time of ignition.

According to the second aspect of the present invention, there is provided a start control apparatus comprising: a fuel injection device for injecting fuel into a combustion chamber of the internal combustion engine; a start demanding device for demanding a start of the internal combustion engine; a starting device for starting the internal combustion engine; a determining device for determining a possibility of self-ignition of the internal combustion engine at a time when a start demand is issued from the start demanding device; and a start procedure control device for injecting the fuel into the combustion chamber by the fuel injection device in the case where the determining device determines that the possibility of the self-ignition of the internal combustion engine is higher than a predetermined level, thereafter starting the internal combustion engine by the starting device.

According to the start control apparatus of the second aspect of the present invention, in the case where it is determined that the possibility of the self-ignition is high, the fuel is injected into the combustion chamber before the start by the starting device, and a temperature in the combustion chamber is lowered based on a latent heat of vaporization of the injected fuel. Further, an air fuel ratio of the air-fuel mixture can be set to a rich state in which the fuel is excess, based on the injected fuel. It is possible to inhibit the self-ignition at a starting time based on the reduction of the combustion chamber temperature, and the rich air fuel ratio of the air-fuel mixture.

In the start control apparatus according to the second aspect of the present invention, the determining device may determine the possibility of the self-ignition of the internal combustion engine with reference to temperature of the internal combustion engine, and the start procedure control device may adjust an amount of the fuel to be injected from the fuel injecting device based on the temperature of the internal combustion engine. It is possible to properly lower the temperature of the internal combustion engine, by adjusting the amount of the injected fuel as mentioned above.

In the start control apparatus according to the second aspect of the present invention, the start procedure control device may increase the amount of the fuel according to an increase of the temperature of the internal combustion engine. Since the latent heat of vaporization can be made larger by increasing the fuel amount, it is possible to quickly lower the temperature.

The start control apparatus according to the second aspect of the present invention may comprise a compression cylinder determining device for determining a cylinder which is first in a compression stroke at the time of starting the internal combustion engine, and the start procedure control device may apply the injection of the fuel to the combustion chamber by the fuel injection device only to the cylinder, which is first in the compression stroke at the start time, determined by the compression cylinder determining device. In the case where the fuel injection is applied only to the cylinder which is first in the compression stroke at the time of starting as mentioned above, it is possible to reduce an amount of consumption of the fuel.

In order to achieve the object mentioned above, according to a third aspect of the present invention, there is provided a start control apparatus comprising: a valve system capable of optionally changing a valve operation characteristic of at least any one of an intake valve and an exhaust valve; a start demanding device for demanding a start of the internal combustion engine; a starting device for starting the internal combustion engine; a detecting device for detecting a first combustion at the time of starting the internal combustion engine; a determining device for determining a possibility of self-ignition of the internal combustion engine at a time when a start demand is issued from the start demanding device; and a start procedure control device for changing the valve operation characteristic of at least any one of the intake valve and the exhaust valve by the valve system so as to prevent a pressure in a combustion chamber of the internal combustion engine from increasing more than a predetermined pressure in the case where the determining device determines that the possibility of the self-ignition of the internal combustion engine is higher than a predetermined level, thereafter starting the internal combustion engine by the starting device, and returning the changed valve operation characteristic to a state before being changed after the detecting device detects the first combustion of the internal combustion engine.

According to the start control apparatus of the third aspect of the present invention, the pressure in the combustion chamber is inhibited from being increased by changing the valve operation characteristic (opening or closing timing, a working angle, a lift amount or the like) of at least one of the intake valve and the exhaust valve in the case where it is determined that the possibility of the self-ignition is high. Therefore, it is possible to inhibit the temperature of the gas in the combustion chamber from being increased due to the compression of the air-fuel mixture, thereby inhibiting the self-ignition. Further, the changed valve operation characteristic is returned after the first combustion is detected, thereby inhibiting a startability from being deteriorated by changing the valve operation characteristic.

In the start control apparatus according to the third aspect of the present invention, the start procedure control device may retard valve closing timing of the intake valve by the valve system so as to inhibit the pressure in the combustion chamber of the internal combustion engine from being increased, and advance the valve closing timing of the intake valve after detecting the first combustion. The pressure in the combustion chamber can be adjusted by changing the valve closing timing of the intake valve in the manner mentioned above.

In the start control apparatus according to the third aspect of the present invention, the determining device may determine the possibility of the self-ignition of the internal combustion engine with reference to temperature of the internal combustion engine, and the start procedure control device may retard the valve closing timing of the intake valve fuel amount according to an increase of the temperature. It is possible to properly inhibit the self-ignition by changing the valve closing timing in correspondence to the temperature of the internal combustion engine and adjusting the increase of the pressure in the combustion chamber.

In the start control apparatus according to the third aspect of the present invention, the starting device may be provided with a start motor and an electric storing device for supplying an electric power to the start motor, and the detecting device may detect the first combustion of the internal combustion engine based on a change in a voltage of the electric storing device. Since an output of the start motor is great until the first combustion is generated, the voltage of the electric storing device is lowered. Further, since the output of the start motor becomes smaller after the first combustion is generated, the voltage of the electric storing device is increased. Accordingly, it is possible to easily detect the first combustion by monitoring the change in the voltage.

As mentioned above, according to the present invention, it is possible to inhibit the self-ignition caused at the time of starting the internal combustion engine, thereby improving the startability of the internal combustion engine.

DESCRIPTION OF THE PREFERRED EMBODIMENTS

Figure 1:
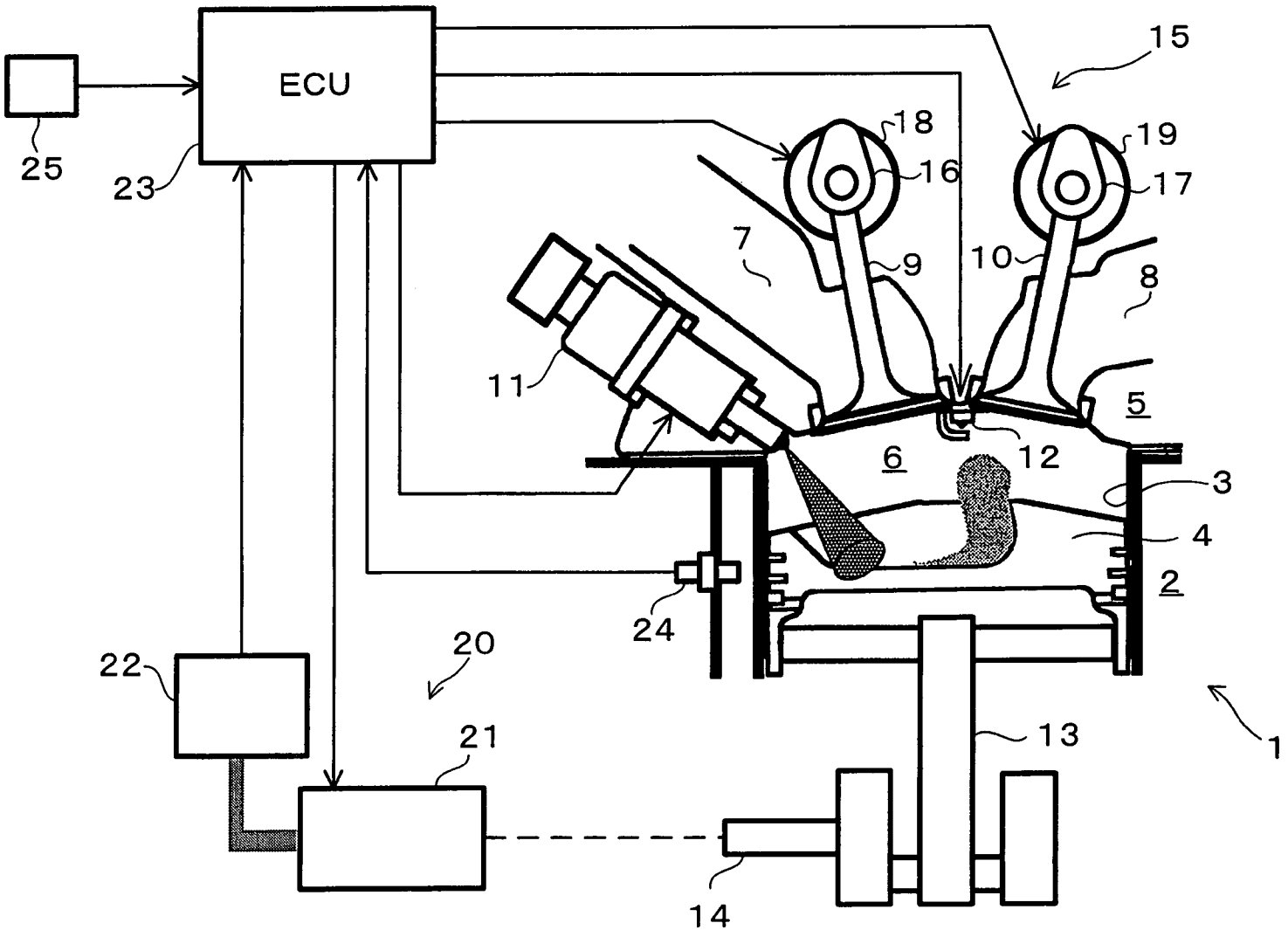
FIG. 1 is a view showing a main portion of an internal combustion engine to which a start control apparatus according to the present invention is applied.

FIG. 1 shows a main portion of an internal combustion engine to which a start control apparatus according to the present invention is applied. An internal combustion engine 1 in FIG. 1 is structured as a cylinder direct injection type four-cycle gasoline engine. A plurality of cylinders 3 (only one is shown in FIG. 1) are formed in a cylinder block 2 of the engine, and a piston 4 is inserted to each of the cylinders 3 so as to be movable in a vertical direction. An opening portion of each of the cylinders 3 is closed by a cylinder head 5, and a combustion chamber 6 is formed in each of the cylinders 3 by a wall surface of the cylinder 3, the piston 4 and the cylinder head 5. An intake passage 7 for sucking intake air, and an exhaust passage 8 for conducting exhaust gas from the combustion chambers to a predetermined exhaust position are connected to each of the combustion chambers 6. Each of the combustion chambers 6 is provided with an intake valve 9 and an exhaust valve 10 (or (intake valves 9 and exhaust valves 10) which are used for opening and closing the passages 7 and 8 with respect to the combustion chamber 6, an injector 11 serving as a fuel injection device for injecting the fuel to the combustion chamber 6, and an ignition plug 12 serving as an ignition device for igniting an air-fuel mixture in the combustion chamber 6. A reciprocating motion of each of the pistons 4 is transmitted as a rotational motion to a crankshaft 14 via a connecting rod 13.

The internal combustion engine 1 is provided with a valve system 15 which can optionally change valve operation characteristics of the valves 9 and 10. The valve system 15 is provided with cam apparatuses 16 and 17 for opening and closing the valves 9 and 10, and valve operation characteristic changing apparatuses 18 and 19 for changing the valve operation characteristics of the valves 9 and 10. Further, the internal combustion engine 1 is provided with a start apparatus 20 serving as a starting device. The start apparatus 20 is provided with a start motor 21, a speed reduction mechanism (not shown) for transmitting a rotational motion of the start motor 21 to the crankshaft 14, and a battery (an electric storing device) 22 for supplying an electric power to the start motor 21.

An operation state of the internal combustion engine 1 is controlled by an engine control unit (ECU) 23. The ECU 23 is structured as a computer by combining a micro processor and peripheral devices such as ROM, RAM and the like required for operating the microprocessor. The ECU 23 adjusts fuel injection timing, a fuel injection amount and ignition timing such that the internal combustion engine 1 is properly operated, for example, by controlling the operations of the injector 11 and the ignition plug 12. Further, the ECU 23 controls the valve system 15 in correspondence to the operation state of the internal combustion engine 1, and changes the valve operation characteristics of the valves 9 and 10. In order to properly control the operations of the various devices in correspondence to the operation state of the internal combustion engine 1, signals are input to the ECU 23 in correspondence to, for example, a cooling water temperature of the internal combustion engine 1 which is output from a water temperature sensor 24 and the like. The specific control thereof may be the same as the known one, and a detailed description will be omitted here.

Figure 2:
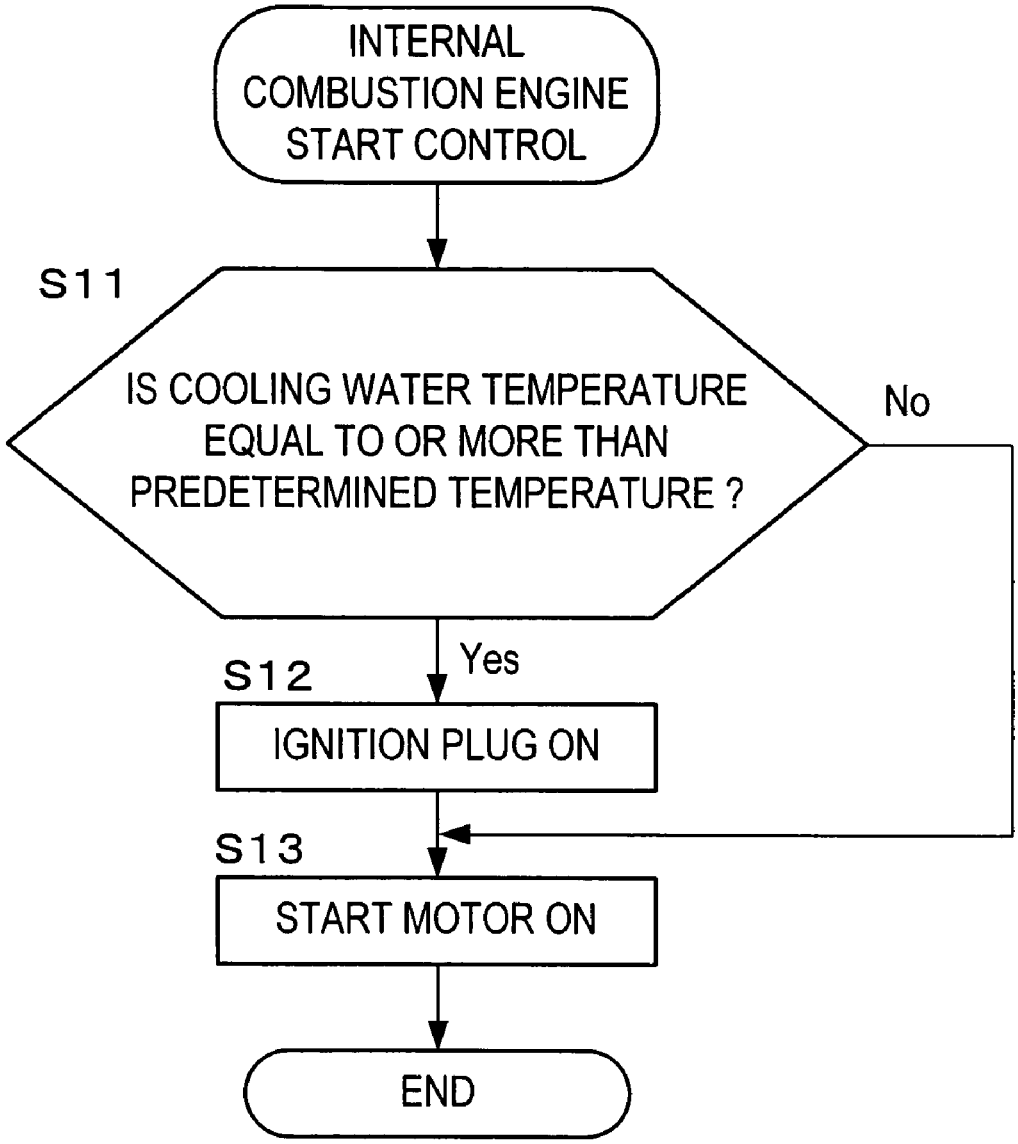
FIG. 2 is a flowchart showing a first control routine executed by an ECU in FIG. 1 for controlling a start of the internal combustion engine.

The ECU 23 controls the operation of the start apparatus 20 to start the internal combustion engine 1. FIG. 2 is a flowchart showing a control routine which the ECU 23 executes for starting the internal combustion engine 1. Further, the ECU 23 monitors the start of the internal combustion engine 1 based on a different routine from the routine in FIG. 2, and issues a start demand of the internal combustion engine 1 in the case where a predetermined condition, for example, an on-state of an ignition switch (IG) 25 or the like, is satisfied. The control routine in FIG. 2 is executed in the case where the start demand is issued. The ECU 23 functions as a start procedure control device and a start demanding device, by executing these control routines.

In the control routine in FIG. 2, the ECU 23 first determines in Step S11 whether or not a temperature of a cooling water (coolant) in the internal combustion engine 1 is equal to or more than a predetermined temperature. The temperature of the cooling water has a correlation with a temperature of the internal combustion engine 1. Accordingly, in the case where the temperature of the cooling water is high, it is possible to determine that a possibility of the self-ignition in the internal combustion engine 1 is high at the time of starting. The ECU 23 functions as a determining device by executing this process. In the case where the ECU 23 determines that the temperature of the cooling water is equal to or more than the predetermined temperature, the ECU 23 goes to Step S12, and operates the ignition plug 12 so as to burn the air-fuel mixture in the combustion chamber 6. In next Step S13, the ECU 23 operates the start motor 21 to start the internal combustion engine 1. Thereafter, the control routine of this time is finished. In this case, when the ECU 23 determines in Step S11 that the temperature of the cooling water is less than the predetermined temperature, Step S12 is skipped.

Figure 3:
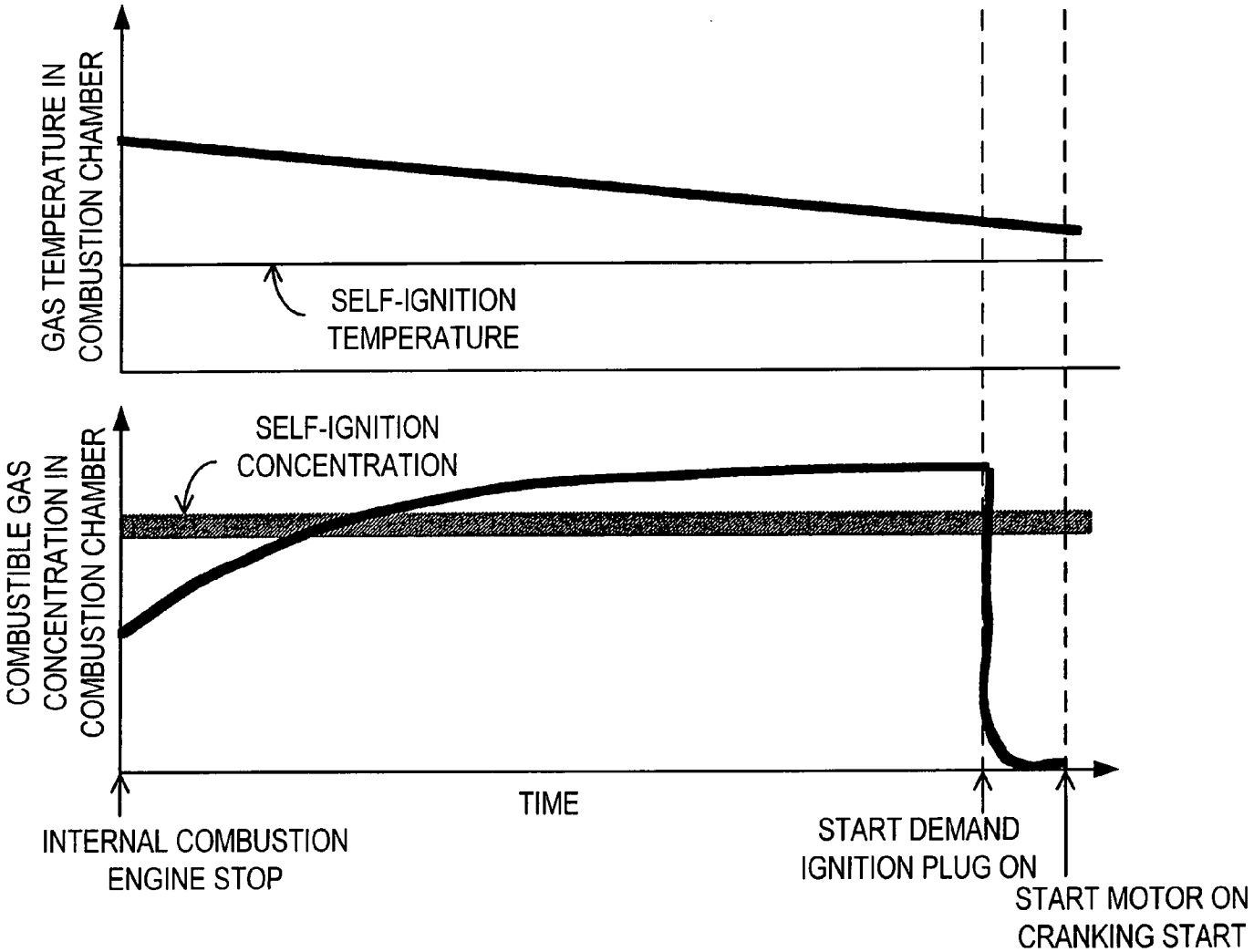
FIG. 3 is a diagram showing one example of temporal changes of a concentration and a temperature of a combustible gas in the combustion chamber in the case of executing the control routine in FIG. 2.

FIG. 3 shows an example of temporal changes of a concentration of combustible gas and temperature thereof in the combustion chamber 6 in the case of executing the control routine in FIG. 2. In the case where the internal combustion engine 1 is stopped after a high load operation, the concentration of the combustible gas in the combustion chamber 6 is gradually increased during the stop of the internal combustion engine 1 by the vaporization of the fuel or the like attached to the wall surface of the cylinder 3 even when the concentration is equal to or less than a concentration (a self-ignition concentration) causing a self-ignition in FIG. 3 at the time of stopping the internal combustion engine 1, whereby the concentration is equal to or more than the self-ignition concentration), as is apparent from FIG. 3. In this case, the self-ignition concentration is experimentally defined as a concentration at which the self-ignition may be caused in a compression process of the air-fuel mixture. Further, in the case where the internal combustion engine 1 is stopped as mentioned above, the gas temperature in the combustion chamber 6 (the temperature of the internal combustion engine 1) is hard to be lowered to be equal to or less than a temperature (a self-ignition temperature) having a high possibility of the self-ignition in FIG. 3. In the case where the start of the internal combustion engine 1 is demanded under such state, the ECU 23 operates the ignition plug 12 to burn the air-fuel mixture in the combustion chamber 6 just after the start demand. The combustible gas concentration is rapidly reduced according to the combustion, and becomes equal to or less than the concentration causing the self-ignition. In this case, the combustion is executed under an approximately atmospheric pressure before the start by the starting device. Accordingly, an inverse rotation of the crankshaft is hard to be caused. Thereafter, the start motor 21 is started, and a cranking of the internal combustion engine 1 is started.

As mentioned above, since the air-fuel mixture in the combustion chamber 6 is burned by the ignition plug 12 before the cranking by the start motor 21 in the case where the possibility of the self-ignition is high, according to the execution of the control routine in FIG. 2, it is possible to inhibit the self-ignition.

Figure 4:
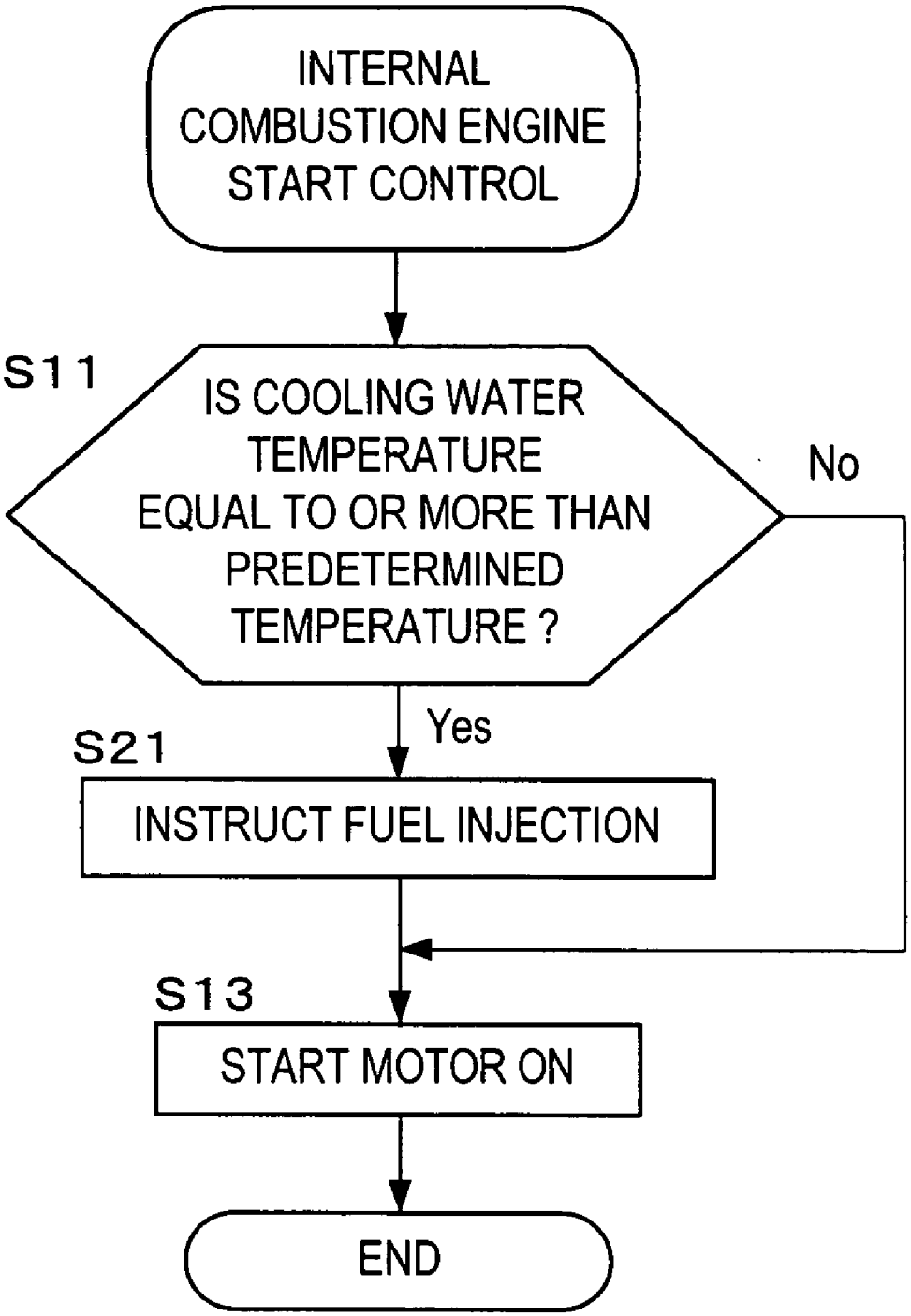
FIG. 4 is a flowchart showing a second control routine executed by the ECU in FIG. 1 for controlling the start of the internal combustion engine.
Figure 5:
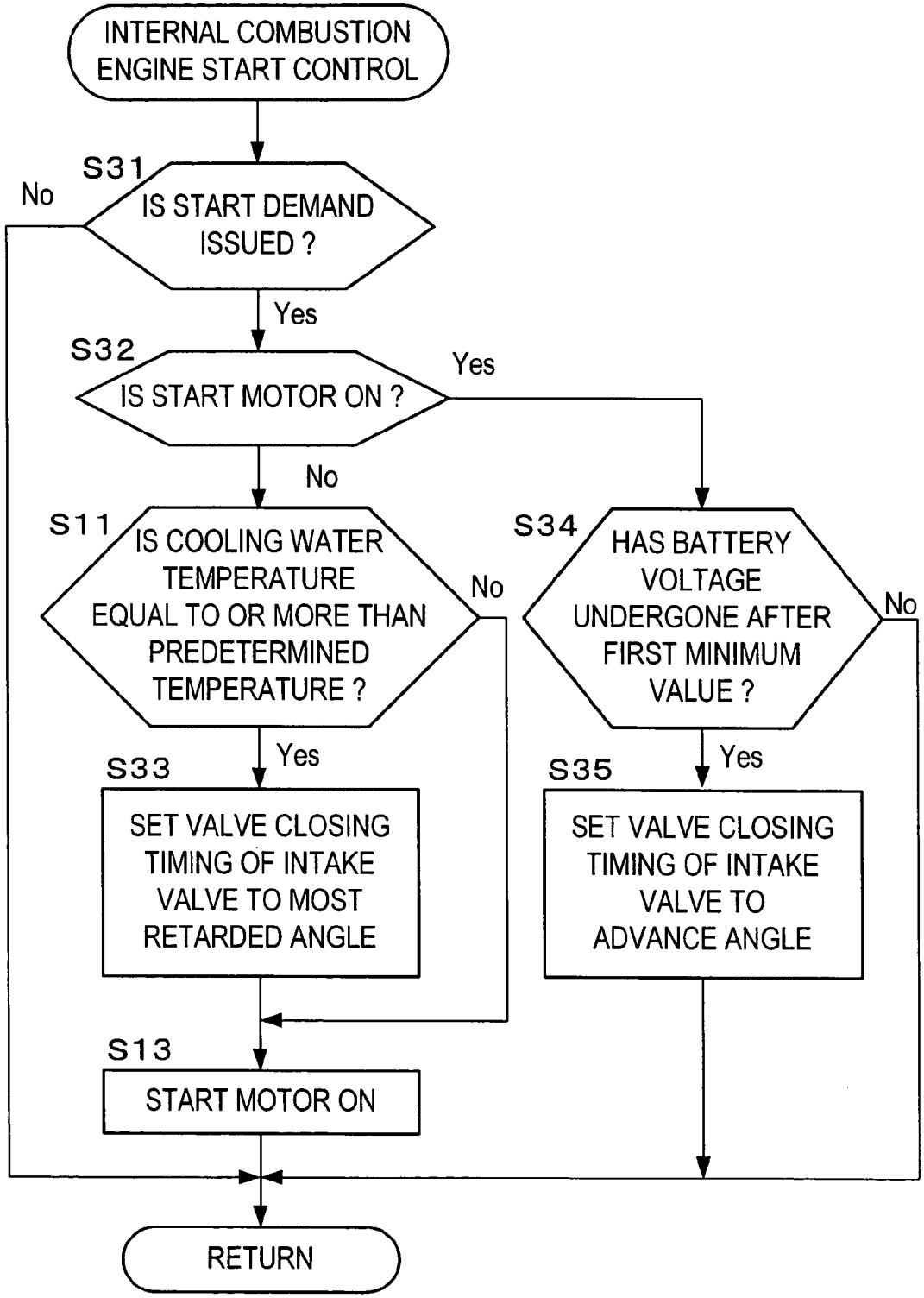
FIG. 5 is a view showing a third control routine executed by the ECU in FIG. 1 for controlling the start of the internal combustion engine.

Next, a description will be given of another example of the control routine for functioning the ECU 23 as the start procedure control device with reference to FIGS. 4 and 5. In FIGS. 4 and 5, the same reference numerals are attached to the same operations as those in FIG. 2, and a description thereof will be omitted.

In the control routine in FIG. 4, the self-ignition of the internal combustion engine 1 is inhibited by injecting the fuel from the injector 11. The control routine in FIG. 4 is executed at the time when the start demand of the internal combustion engine 1 is issued. In the control routine in FIG. 4, the ECU 23 first determines in Step S11 whether or not the temperature of the cooling water is equal to or more than a predetermined temperature. In the case where the ECU 23 determines that the temperature of the cooling water is equal to or more than the predetermined temperature, the ECU 23 goes to Step S21, and operates the injector 11 to inject the fuel into the combustion chamber 6. An amount of the fuel to be injected from the injector 11 is adjusted in correspondence to the temperature of the cooling water, for example, the fuel amount is increased in the case where the temperature of the cooling water is high. Thereafter, the ECU 23 goes to Step S13, and subsequently executes the same operation as the control routine in FIG. 2.

Figure 6:
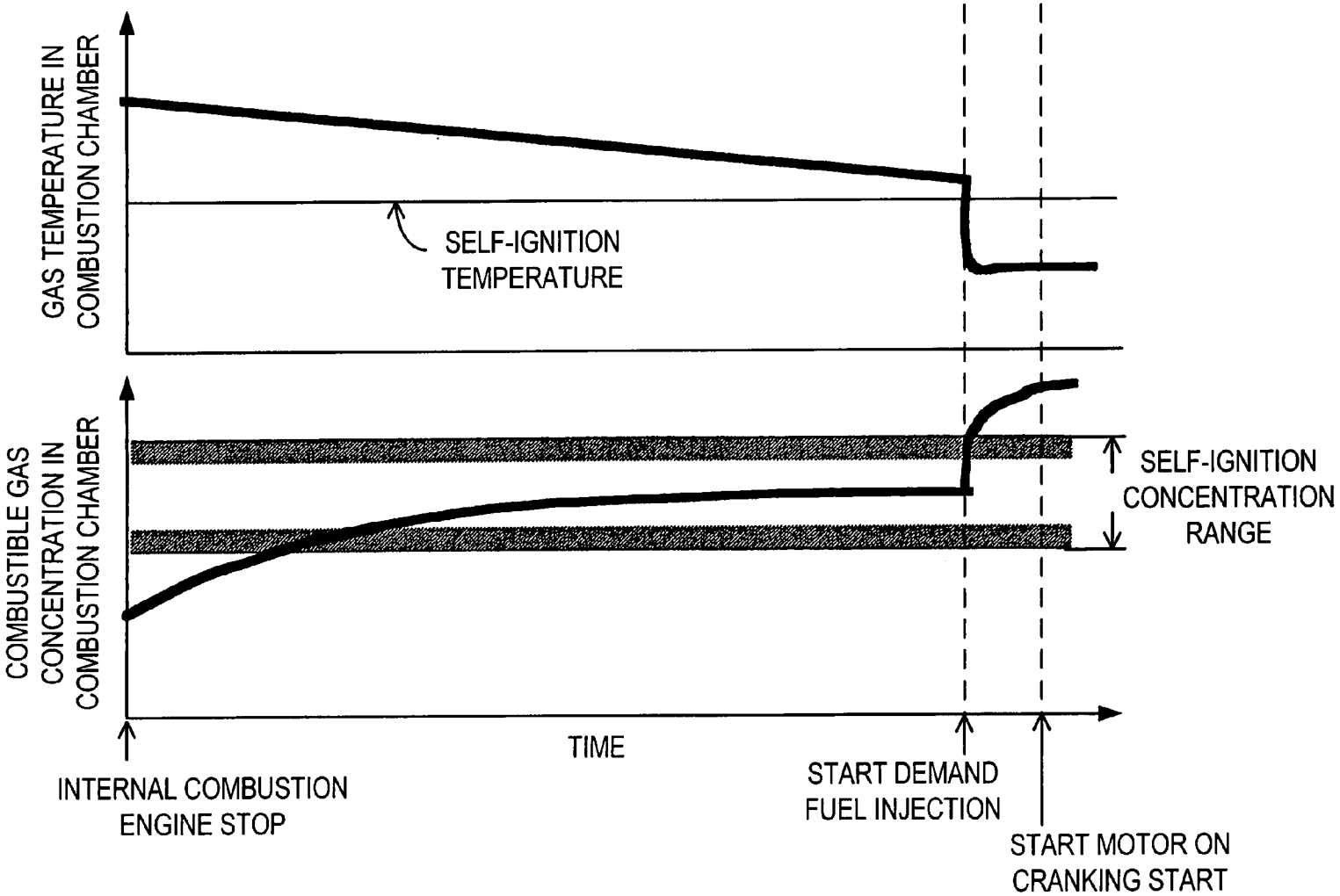
FIG. 6 is a diagram showing one example of the temporal changes of the concentration and the temperature of the combustible gas in the combustion chamber in the case of executing the control routine in FIG. 4.

FIG. 6 shows an example of temporal changes of a concentration of combustible gas and temperature of the gas in the combustion chamber 6 in the case of executing the control routine in FIG. 4. As is apparent from FIG. 6, the concentration of the combustible gas in the combustion chamber 6 in the case of stopping the internal combustion engine 1 from a high load operation or the like becomes in a self-ignition concentration range in FIG. 6 due to the vaporization of the fuel attached to the inside of the cylinder 3 during the stop of the internal combustion engine 1. Further, the temperature of the gas in the combustion chamber 6 is not lowered to be equal to or less than the self-ignition temperature in FIG. 6. In the case where the start of the internal combustion engine 1 is demanded under the state mentioned above, the ECU 23 operates the injector 11 just after the start demand to inject the fuel into the combustion chamber 6. The injected fuel causes the temperature of the gas in the combustion chamber 6 to be lowered to a temperature below the self-ignition temperature based on the latent heat of vaporization, and makes an air fuel ratio of the air-fuel mixture rich to increase the concentration of the combustible gas out of the self-ignition concentration range. Thereafter, the start motor 21 is started, and the cranking of the internal combustion engine 1 is started.

Accordingly, the self-ignition at the time of starting can be inhibited by executing the control routine in FIG. 4. In this case, the ECU 23 may have a function of ascertaining the ignition timing of each of the cylinders 3 or the like with reference to an angle of the crank shaft 14 or the like during the operation of the internal combustion engine 1, and referring the ignition timing or the like obtained during the operation at the time of stopping the internal combustion engine 1, thereby determining which cylinder is first in the compression stroke at the time of starting. The ECU 23 functions as the compression cylinder determining device by determining the cylinder in the manner mentioned above. In this case, the ECU 23 may apply the operation of Step S12 in FIG. 2 and the operation of Step S21 in FIG. 4 only to the ignition plug 12 or the injector 11 in the cylinder which is first in the compression stroke at the time of starting. The electric power consumption and the injected fuel amount at the time of ignition can be reduced by applying the operation only to the cylinder which is first in the compression stroke.

In a control routine in FIG. 5, the self-ignition of the internal combustion engine 1 is inhibited by changing valve closing timing of the intake valve 9. The control routine in FIG. 5 is started at the same time of starting the ECU 23, and is repeatedly executed at a predetermined cycle during the operation of the ECU 23. In the control routine in FIG. 5, the ECU 23 first in Step S31 determines whether or not the start demand of the internal combustion engine 1 is issued. In the case where the ECU 23 determines that the start demand is not issued, the control routine of this time is finished. In the case where the ECU 23 determines that the start command is issued, the ECU 23 goes to Step S32, and determines whether or not the start motor 21 is operated. In the case where the ECU 23 determines that the start motor 21 is not operated, the ECU 23 goes to Step S11, and determines whether or not the temperature of the cooling water is equal to or more than a predetermined temperature. In the case where the ECU 23 determines that the temperature of the cooling water is equal to or more than the predetermined temperature, the ECU 23 goes to Step S33, and sets the valve closing timing of the intake valve 9 to the most retarded angle. In this case, the position at which the valve closing timing of the intake valve 9 is retarded is not limited to the most retarded angle. An amount of retarded angle of the valve closing timing may be set in correspondence to the temperature of the cooling water, for example, the valve closing timing can be retarded more with the temperature of the cooling water being increased. The pressure is adjusted to prevent the pressure in the combustion chamber 6 from being increased over the predetermined pressure having a high possibility that the pressure in the combustion chamber 6 causes the self-ignition at the time of cranking, by retarding the valve closing timing of the intake valve 9. In succeeding Step S13, the ECU 23 operates the start motor 21. In the case where ECU 23 determines in Step S11 that the temperature of the cooling water is less than the predetermined temperature, Step S33 is skipped.

Figure 7:
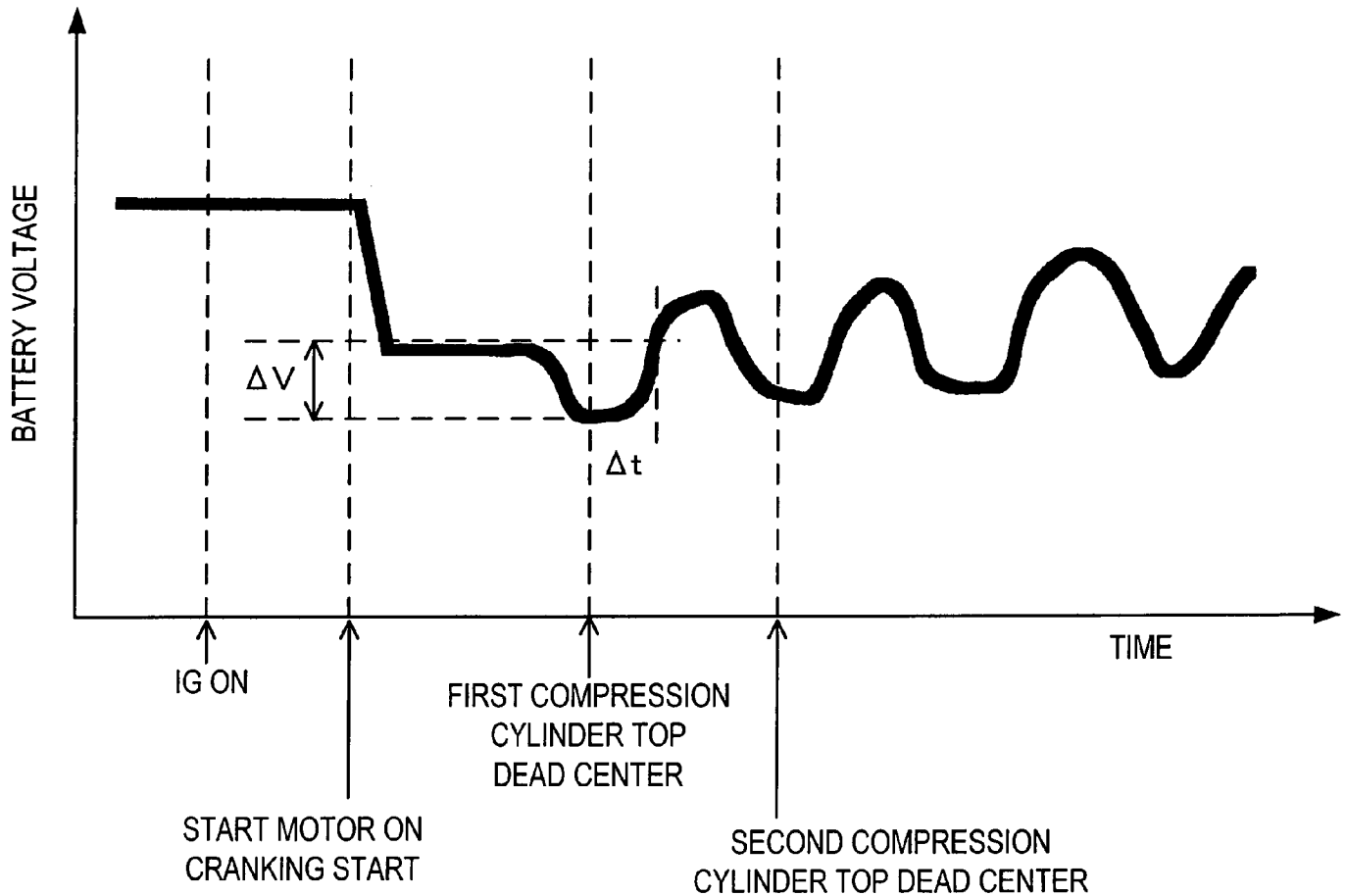
FIG. 7 is a diagram showing one example of a temporal change of a battery voltage at the time of starting the internal combustion engine.

In the case where the ECU 23 determines in Step S32 that the start motor 21 is operated, the ECU 23 goes to Step S34, and determines whether or not a voltage of the battery 22 has undergone a minimum value (the first minimum value) which first appears after starting the internal combustion engine 1. FIG. 7 shows an example of a temporal change of a voltage of the battery 22 at the time of starting the internal combustion engine 1. As is apparent from FIG. 7, the voltage of the battery 22 is not increased until the piston in the cylinder 3 (the first compression cylinder), which is first in the compression stroke at the time of starting, moves to a top dead center. Accordingly, it is possible to determine whether or not the piston in the first compression cylinder has passed the top dead center, by monitoring a voltage change rate $\Delta V$ (a slope of a voltage change) of the battery 22 during $\Delta t$ after the operation of the start motor 21. For example, in the case where $\Delta V$ is larger than 0 (in the case where the voltage changes via the first minimum value), the first compression stroke of the internal combustion engine 1 is finished, whereby it is determined that the first combustion is executed. The ECU 23 functions as the detecting device by monitoring the voltage of the battery 22 as mentioned above. In the case where the ECU 23 determines in Step S34 that the voltage has not changed so as to undergo the first minimum value, the control routine of this time is finished.

On the other hand, in the case where the ECU 23 determines that the voltage changes so as to undergo the first minimum value, the ECU 23 goes to Step S35, and advances the valve closing timing of the intake valve 9. Thereafter, the control routine of this time is finished.

As is described above, the self-ignition of the internal combustion engine 1 can be inhibited by changing the valve closing timing of the intake valve 9 to inhibit the pressure in the combustion chamber at the time of starting from being increased. Further, since the valve closing timing of the intake valve 9 is advanced after detecting the first combustion, it is possible to inhibit the deterioration of the startability caused by retarding the valve closing timing. In this case, the pressure adjustment of the combustion chamber 6 is not limited to the adjustment achieved by changing the valve closing timing of the intake valve 9. For example, the pressure may be adjusted by changing the other valve operation characteristics such as the lift amount of the intake valve 9 and the like besides the valve closing timing, or may be adjusted by changing the valve operation characteristic of the exhaust valve 10. Further, the detection whether or not the piston in the first compression cylinder has already moved through the top dead center is not limited to the detection by the voltage change of the battery 22, and for example, may be detected by monitoring torque change in the internal combustion engine 1 or the pressure change in the combustion chamber 6.

The start control apparatus according to the present invention can be applied to an internal combustion engine, in an internal combustion engine of a so-called hybrid vehicle in which a motor generator serving as an electric motor and a power generator and the internal combustion engine are installed as power sources, or an internal combustion engine which executes a so-called idling stop for temporarily stopping the internal combustion engine in the case where a predetermined condition is satisfied for restarting the engine. In the internal combustion engine mentioned above, it is possible to determine the possibility of the self-ignition based on the time (time length) in which the internal combustion engine is temporarily stopped.

Figure 8:
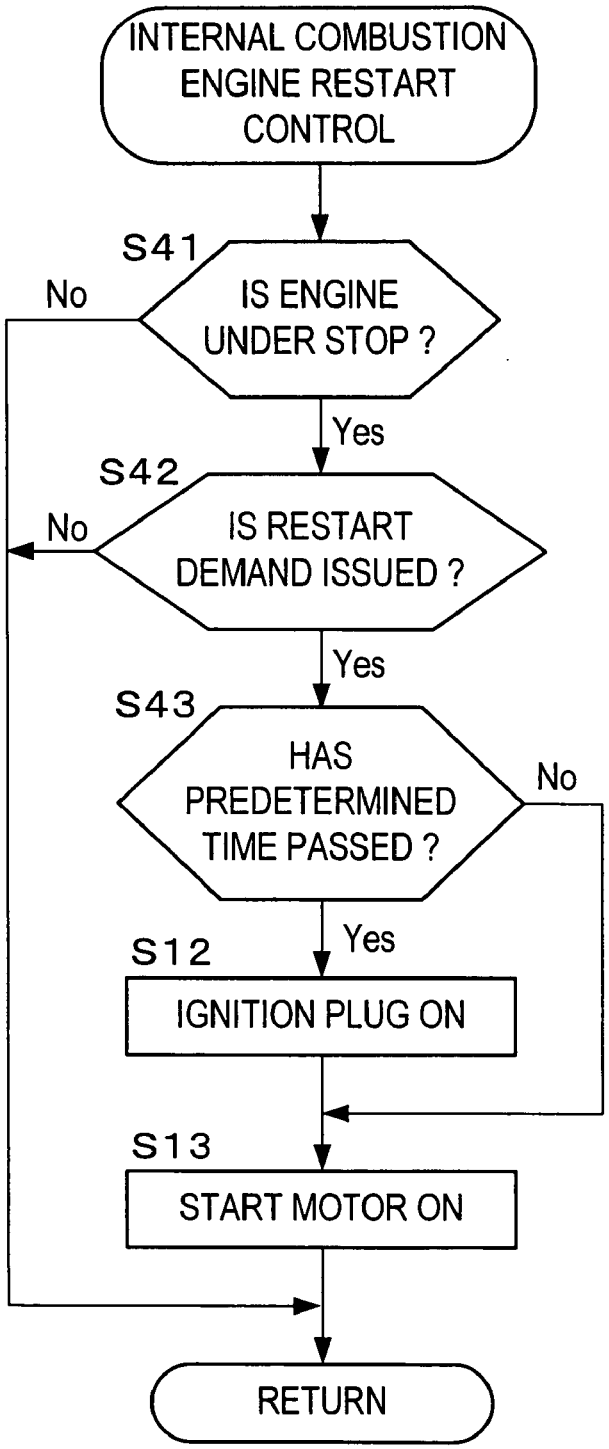
FIG. 8 is a flowchart showing a control routine which the ECU 23 executes at the time of restarting the internal combustion engine for temporarily interrupting the restart of the engine in the case where a predetermined condition is not satisfied.

FIG. 8 is a flowchart showing an example of a control routine which the ECU 23 executes for restarting the internal combustion engine. The routine in FIG. 8 is started in the case where the ECU 23 is started, and is repeatedly executed at a predetermined cycle during the operation of the ECU 23. In this case, in FIG. 8, the same reference numerals are attached to the same operations as those in FIG. 2, and a description thereof will be omitted.

In the control routine in FIG. 8, the ECU 23 first determines in Step S41 whether or not the internal combustion engine 1 has been stopped. In the case where the ECU 23 determines that the internal combustion engine 1 has not been stopped, the control routine of this time is finished. In the case where the ECU determines that the internal combustion engine 1 has been stopped, the ECU 23 goes to Step S42, and determines whether or not the restart demand of the internal combustion engine 1 is issued. The restart demand is issued in the case where the internal combustion engine 1 is in a temporarily stop state, for example, in the case where an accelerator pedal or a clutch pedal is pedaled or a transmission is operated. If the ECU 23 determines that the restart demand is not issued, the control routine of this time is finished. If the ECU 23 determines that the restart demand is issued, the ECU 23 goes to Step S43, and determines whether or not a predetermined time has elapsed after the internal combustion engine 1 is stopped. The predetermined time is set, for example, to a time by which the fuel attached to the wall surface of the cylinder 3 can be vaporized and the concentration of the combustible gas in the combustion chamber 6 reaches the self-ignition concentration. In the case where the ECU 23 determines that the predetermined time has elapsed, the ECU 23 goes to Step S12, and operates the ignition plug 12 to burn the air-fuel mixture in the combustion chamber 6. In succeeding Step S13, the ECU 23 operates the start motor 21 to start the internal combustion engine 1. Thereafter, the control routine of this time is finished. In the case where the ECU determines in Step S43 that the predetermined time has not elapsed, Step S12 is skipped.

As mentioned above, it is possible to inhibit the self-ignition in the case of restarting after temporarily stopping the internal combustion engine 1, by executing the control routine in FIG. 8. The ignition plug 12 is used in FIG. 8, however, the self-ignition may be inhibited by using the injector 11, and the valves 9 and 10. In the internal combustion engine mentioned above, since the internal combustion engine is stopped and restarted at a large number of times, the start control apparatus according to the present invention is preferably applied.

The present invention is not limited to the embodiment mentioned above, but may be carried out based on various aspect. The internal combustion engine is not limited to the cylinder direct injection type internal combustion engine, but can be applied to a port injection type internal combustion engine which injects the fuel to an intake port. The starting device is not limited to the start motor, but can employ, for example, a device which generates the combustion in the cylinder under an expansion stroke at the time of starting to start the internal combustion engine.

The device for acquiring the temperature of the internal combustion engine for determining the possibility of the self-ignition is not limited to the temperature of the cooling water. For example, the temperature of the internal combustion engine may be acquired based on a temperature of a lubricating fluid in the internal combustion engine or a temperature of intake air. Further, since the self-ignition is hard to be caused in the case where the rotation speed of the crankshaft is high at the time of starting the internal combustion engine, and the self-ignition is easily caused in the case where the rotation speed is low, it is possible to determine the possibility of the self-ignition based on the rotation speed at the time of starting.

What is claimed is:

1. A start control apparatus of an internal combustion engine comprising:

a valve system capable of optionally changing a valve operation characteristic of at least any one of an intake valve and an exhaust valve;

a start demanding device for demanding a start of the internal combustion engine;

a starting device for starting the internal combustion engine;

a detecting device for detecting a first combustion at the time of starting the internal combustion engine;

a determining device for determining a possibility of self-ignition of the internal combustion engine at a time when a start demand is issued from the start demanding device; and a start procedure control device for changing the valve operation characteristic of at least any one of the intake valve and the exhaust valve by the valve system so as to prevent a pressure in a combustion chamber of the internal combustion engine from increasing more than a predetermined pressure in the case where the determining device determines that the possibility of the self-ignition of the internal combustion engine is higher than a predetermined level, thereafter starting the internal combustion engine by the starting device, and returning the changed valve operation characteristic to a state before being changed after the detecting device detects the first combustion of the internal combustion engine.

2. The start control apparatus of the internal combustion engine according to claim 1, wherein the start procedure control device retards valve closing timing of the intake valve by the valve system so as to inhibit the pressure in the combustion chamber of the internal combustion engine from being increased, and advances the valve closing timing of the intake valve after detecting the first combustion.

3. The start control apparatus of the internal combustion engine according to claim 2, wherein the determining device determines the possibility of the self-ignition of the internal combustion engine with reference to temperature of the internal combustion engine, and the start procedure control device retards the valve closing timing of the intake valve according to an increase of the temperature.

4. The start control apparatus of the internal combustion engine according to claim 1, wherein the starting device is provided with a start motor and an electric storing device for supplying electric power to the start motor, and the detecting device detects the first combustion of the internal combustion engine based on a change in a voltage of the electric storing device.

* * * * *